US005215062A

United States Patent [19]

Asano et al.

[11] Patent Number: 5,215,062

[45] Date of Patent: Jun. 1, 1993

[54] FUEL CONTROL DEVICE AND METHOD FOR INTERNAL COMBUSTION ENGINE

[75] Inventors: Seiji Asano, Katsuta; Toshio Ishii, Mito, both of Japan

[73] Assignee: Hitachi, Ltd., Tokyo, Japan

[21] Appl. No.: 922,390

[22] Filed: Jul. 31, 1992

[30] Foreign Application Priority Data

Jul. 31, 1991 [JP] Japan ..... 3-235772

[51] Int. Cl.[5] ..... F02D 41/18

[52] U.S. Cl. ..... 123/491; 123/480; 123/486

[58] Field of Search ..... 123/491, 488, 494, 480, 123/486; 364/431.05, 431.1

[56] References Cited

U.S. PATENT DOCUMENTS 4,785,785 11/1988 Oba et al. ..... 123/488

*Primary Examiner*—Andrew M. Dolinar

*Attorney, Agent, or Firm*—Antonelli, Terry, Stout & Kraus

[57] ABSTRACT

In a fuel control device for an internal combustion engine wherein an estimated pressure (Pi) in the engine intake manifold is calculated by digital filtering an output signal from a H/W sensor by making use of a difference equation, an air flow rate (Qc) at the engine cylinder port is estimated based upon a detected engine rotating number (N) and the calculated estimated pressure (Pi) by retrieving a value of air flow rate from a map defined by the engine rotating number (N) and the estimated pressure (Pi) in the engine intake manifold. Then, the fuel quantity (Tp) to be injected is calculated based upon a detected engine rotating number (N) and the estimated air flow rate (Qc) at the engine cylinder port. However during the engine starting period, a learned estimated pressure in the engine intake manifold is used instead of the calculated estimate pressure (Pi) in the engine intake manifold to determined the retrieved estimated air flow rate (Qc). The learned estimated pressure in the engine intake manifold for the engine starting period is obtained by taking in a value of calculated estimated pressure (Pi) in the engine intake manifold immediately after the engine reaches a complete explosion condition, whereby the interval from the engine start to the engine start completion is shortened, the starting characteristic of the motor vehicle is improved and degradation of exhaust gas is suppressed.

8 Claims, 5 Drawing Sheets

FUEL CONTROL DEVICE AND METHOD FOR INTERNAL COMBUSTION ENGINE

BACKGROUND OF THE INVENTION

The present invention relates to a fuel control device and method for an internal combustion engine, such as a gasoline engine for a motor vehicle, in which the fuel quantity to be injected is controlled by estimating an accurate air flow rate at the engine cylinder port flowing into the respective engine cylinders by making use of a heat generating resistor type air flow meter.

Many kinds of fuel supply quantity control devices and methods for an internal combustion engine, such as a gasoline engine for a motor vehicle, are known. One example is a device of the type which operates to obtain an estimated pressure at the engine intake manifold by digital-filtering the signal obtained from a heat generating resistor type air flow meter, such as a hot wire type air flow meter. This is accomplished by making use of a difference equation to estimate the air flow rate at the engine cylinder port flowing into the respective engine cylinders by accessing a predetermined cylinder flow-in air flow rate map defined by the obtained estimated pressure at the engine intake manifold and the engine rotating number and to control the fuel supply quantity based upon the estimated cylinder flow-in air flow rate. This type of fuel supply quantity control device has the advantages that no intake air temperature compensation is needed because the fuel quantity is determined by making use of the heat generating resistor type air flow meter and that certain adverse effects, such as manifold charge, are eliminated because the pressure in the intake manifold, an internal state variable, is employed for the determination. Such operation is known as a fuel supply quantity control method having a high accuracy and tracking characteristic.

JP-A-55-146241(1980), JP-A-55-148926(1980), JP-A-62-87648(1987), JP-A-64-32050(1989), JP(PCT)-A-1-501077(1989) and JP-A-1-240753(1989) disclose examples of the above explained conventional devices and methods.

The above conventional devices and methods did not take into account the convergence period encountered at the initial period of operation in the course of their digital filtering process; therefore there was a problem that the starting-up of the internal combustion engine (hereinafter simply called an engine) was difficult because, during starting-up of the engine, many kinds of data in the control unit tend to be disturbed and deviate from their proper conditions.

SUMMARY OF THE INVENTION

An object of the present invention is to provide a fuel control device and method for an internal combustion engine having an excellent starting characteristic regardless of the fact that the digital filtering process of the output signal from the heat generating resistor type air flow meter is performed therein.

The object of the present invention is achieved by a fuel control device and method for an internal combustion engine which comprise a calculating means which calculates an estimated pressure in the intake manifold by digital filtering the output signal from a heat generating resistor type air flow meter for measuring an intake air flow rate by making use of a difference equation and estimates an air flow rate at the engine cylinder port flowing into the respective cylinders of the internal combustion engine based upon the calculated estimate pressure in the intake manifold, and calculates an optimum fuel supply quantity for the internal combustion engine based upon the estimated air flow rate by use of the calculating means. The present invention further comprises means for providing a predetermined air flow rate independent from the estimated air flow rate from the calculating means, whereby the calculation of the optimum fuel supply quantity for a predetermined period after the calculating means has started its operation is performed based upon the predetermined air flow rate.

The predetermined air flow rate is obtained either by successive learning of initial values of the estimated pressure in the intake manifold during an engine starting period by taking in calculated estimated pressures in the intake manifold during the engine starting period somewhere at the moment when the complete explosions in engine cylinders have occurred or by theoretical analysis or experimental study depending upon the subject internal combustion engines; and, during the engine starting period, the fuel supply quantity is calculated based upon a predetermined air flow rate which is not disturbed due to the convergence period of the digital filter, such that the fuel control device and method for an internal combustion engine according to the present invention provides a satisfactory starting characteristic.

DESCRIPTION OF THE PREFERRED EMBODIMENTS

Figure 1:
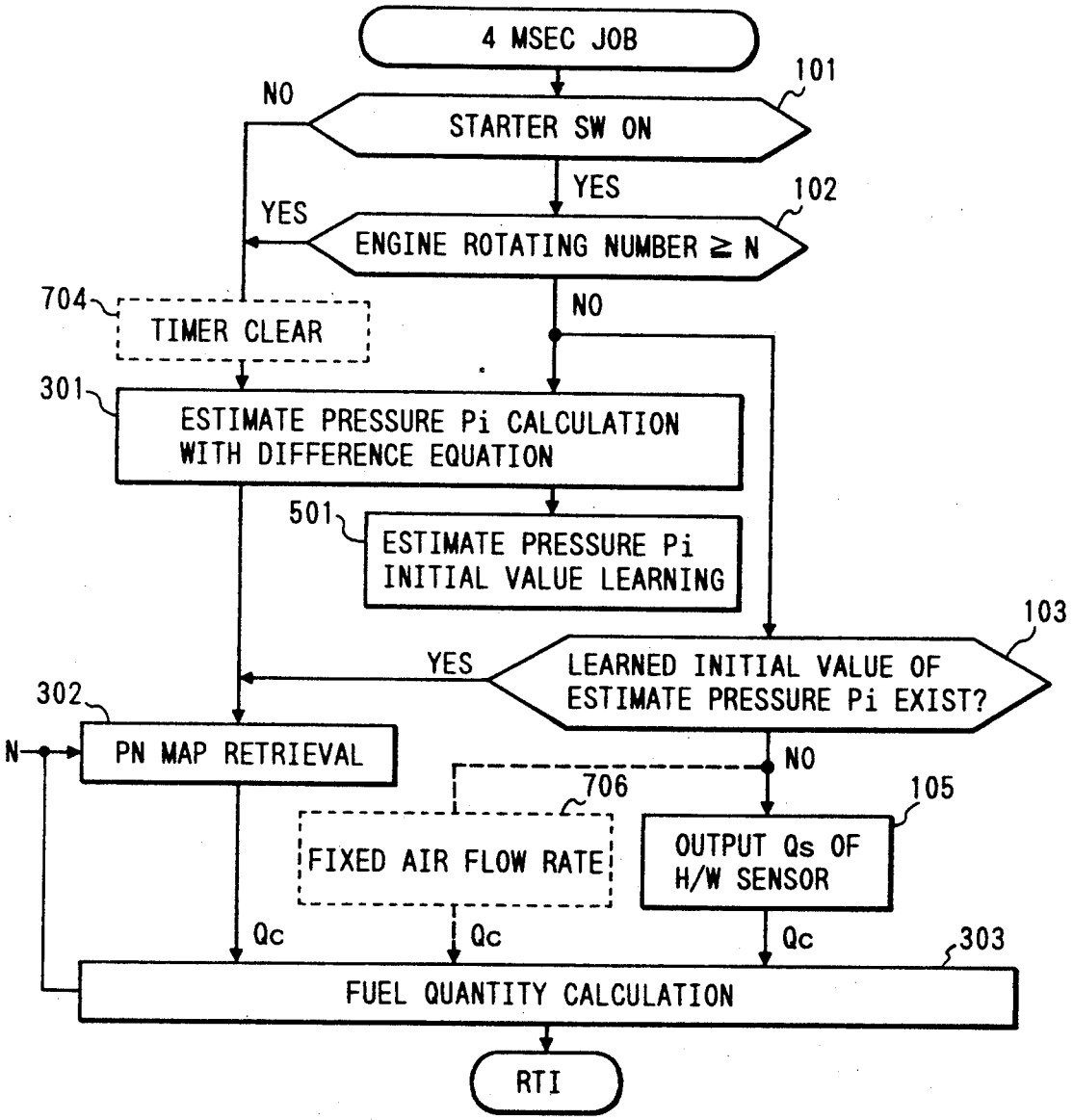
FIG. 1 is a flowchart for explaining embodiments of a fuel control method for an internal combustion engine according to the present invention.

Hereinbelow, the fuel control device and method for an internal combustion engine according to the present invention will be explained with reference to the embodiments as shown in the drawings, in which the same numerals and symbols are used for the same or equivalent elements and processings.

Figure 2:
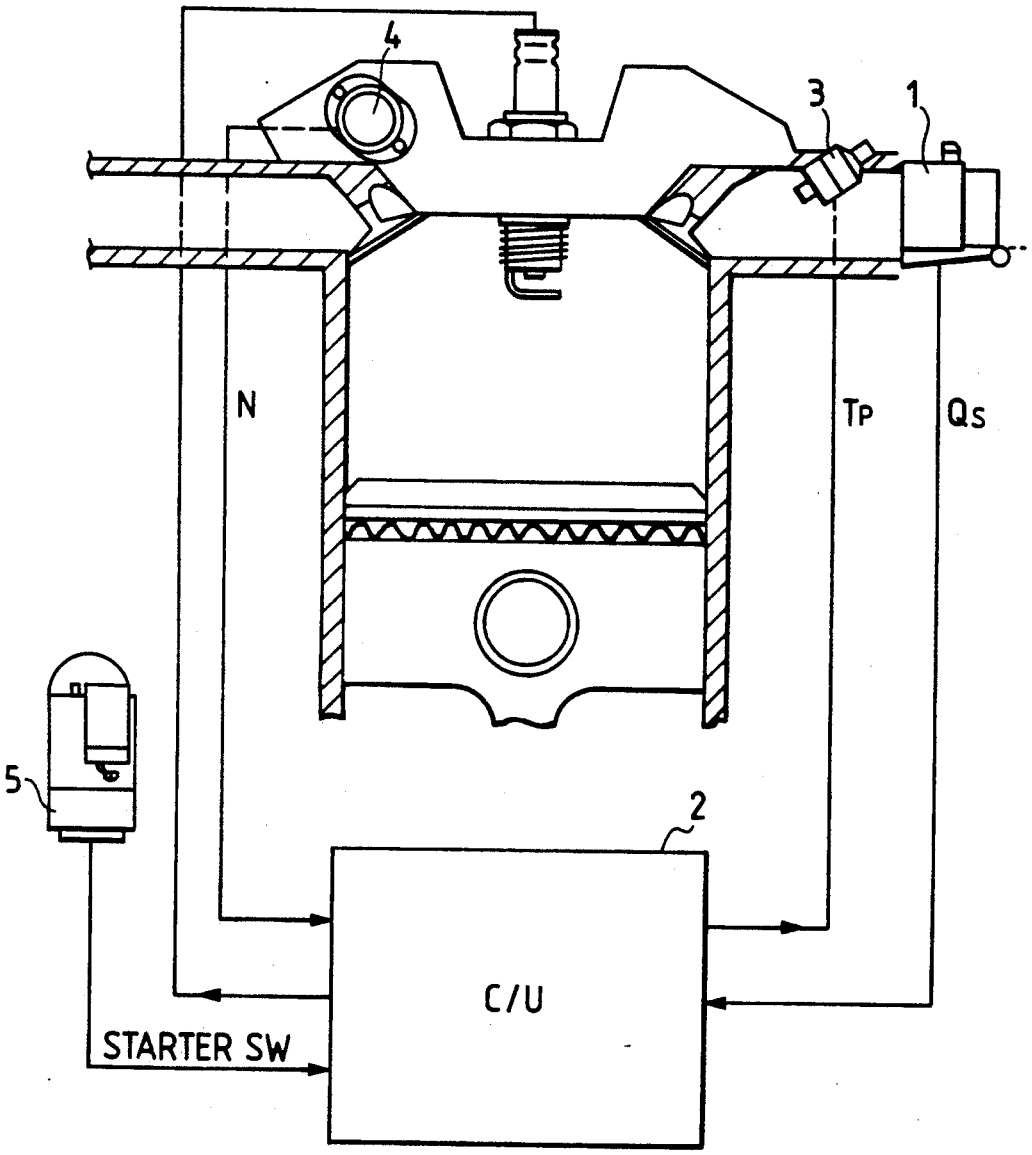
FIG. 2 is a block diagram of an engine system to which the embodiment shown in FIG. 1 may be applied.

FIG. 2 is an schematic diagram of part of an internal combustion engine to which the embodiments of the present invention are applied. In the drawing reference numeral 1 is a hot wire type air flow meter (hereinafter simply called H/W sensor), 2 is a control unit, 3 is a fuel injection valve, 4 is a crank angle sensor and 5 is a starter.

The H/W sensor is a kind of heat generating resistor type air flow meter, and functions to measure the intake air flow rate into the engine in the form of a mass air flow rate and to output an air flow rate signal Qs.

The control unit 2 is provided with a microcomputer and functions to take-in signals such as from a variety of sensors, to perform digital processing thereon and to calculate an optimum fuel quantity and ignition timing in response to engine operating conditions.

The fuel injection valve 3 is actuated by a driving signal Tp provided by the control unit 2 and functions to inject the corresponding quantity of fuel into the engine intake pipe.

The crank angle sensor 4 detects the crank angle of the engine and functions to output an electrical signal N representing an engine rotating speed.

The starter 5 begins rotation of the engine when the starter switch is turned on and functions to crank the engine for starting.

Figure 3:
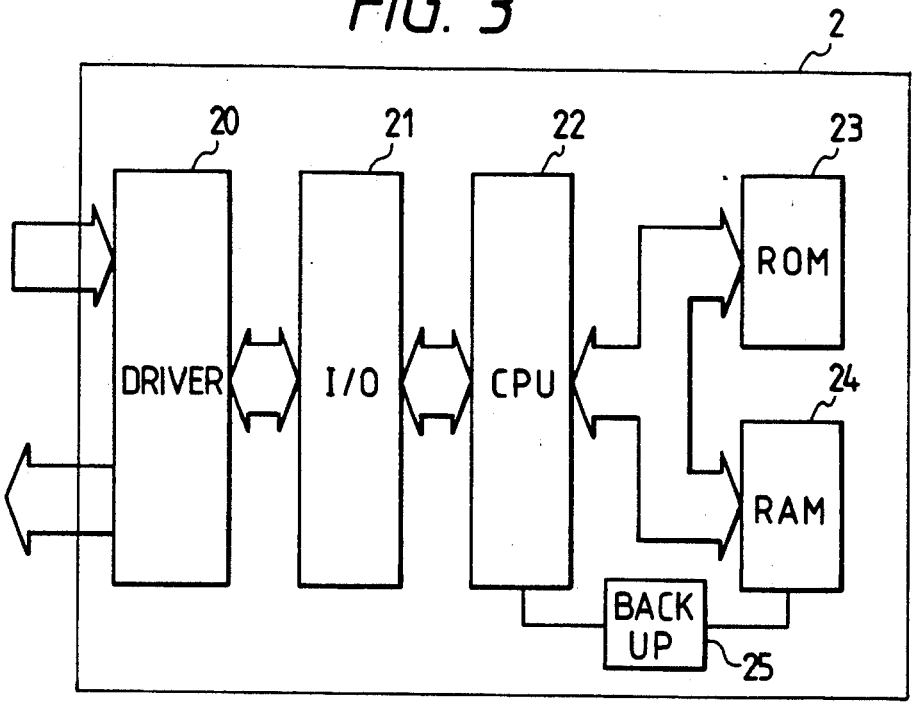
FIG. 3 is a block diagram for explaining internal circuits in the control unit 2 shown in FIG. 2.

FIG. 3 is a block diagram showing internal circuits in the control unit 2 in which the embodiments according to the present invention are realized, as shown in the drawing. The control unit 2 is constituted by a driver 20, which controls input and output signal levels from and to a variety of external sensors and actuators; an I/O unit 21 which converts output signal voltages from the respective sensors into digital signals and sends out pulse signals to the respective actuators; a CPU 22 which performs digital operations on the output signals from the I/O 21, calculates a fuel injection time width and sends back the calculation result to the I/O 21; a ROM 23 operating as a non-voltatile memory which stores programs and constants of the CPU 22; a RAM operating as a volatile memory 24 which temporally stores calculated variables; and a backup power source circuit 25 for the CPU 22 and the RAM 24.

Figure 4:
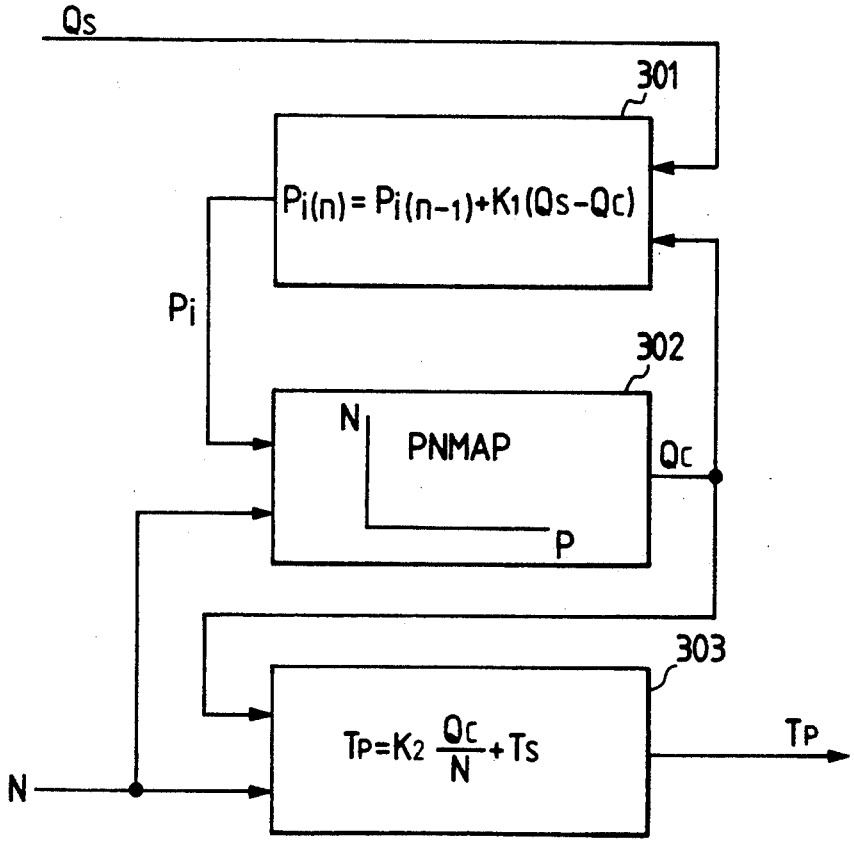
FIG. 4 is a block diagram for explaining in detail the processing in the estimated pressure Pi calculation 301 with a difference equation, the PN map retrieval 302 and the fuel quantity calculation 303 shown in FIG. 1.

FIG. 4 is a block diagram for explaining the estimated pressure calculation, the PN map retrieval and the fuel quantity calculation in the embodiments according to the present invention. The processings at blocks 301~303 in the drawing are executed by digital operation in the microcomputer through an interruption at every predetermined period.

In the processing block 301, a calculating operation which makes use of a pressure difference equation is executed. Pi(n) in the left side of the pressure difference equation represents the present estimated pressure in the intake manifold to be calculated, Pi(n−1) the first term on the right side of the equation represents the previous estimated pressure in the intake manifold and K1(Qs−Qc) the second term on the right side of the equation represents a pressure variation which is obtained by multiplying a difference between the present output Qs of the H/W sensor 1 and the air flow rate Qc at the engine cylinder port retrieved from the PN map in the processing block 302 with a constant K1.

In the processing block 302, a retrieving operation is executed by making use of a two dimensional PN map which determines air flow rate at the engine cylinder port possibily flowing into the respective cylinders and has axes of pressure Pi in the intake manifold and engine rotating number N. The processing block 302 receives as one input the pressure Pi calculated at the processing block 301 and as another input the engine rotating number N calculated on the basis of the signal from the crank angle sensor 4 and outputs an estimated air flow rate Qc at the engine cylinder port. For the retrieval of the estimated air flow rate Qc at the engine cylinder port, a surface interpolation is employed. The air flow rate Qc at the engine cylinder port retrieved at the processing block 302 constitutes an input for the processing block 301 which performs the calculation with the pressure difference equation and for the processing block 303 which performs a calculation of the fuel quantity to be injected.

In the processing block 303, a calculating operation of the fuel quantity to be injected is executed wherein a fuel injection quantity Tp is calculated by dividing the air flow rate Qc at the engine cylinder port, of which the unit is Kg/h, by the rotating number N, and multiplying the divided result with an injector constant K2 and further adding the multiplied result to the ineffective injection width Ts of the fuel injection valve.

Figure 5:
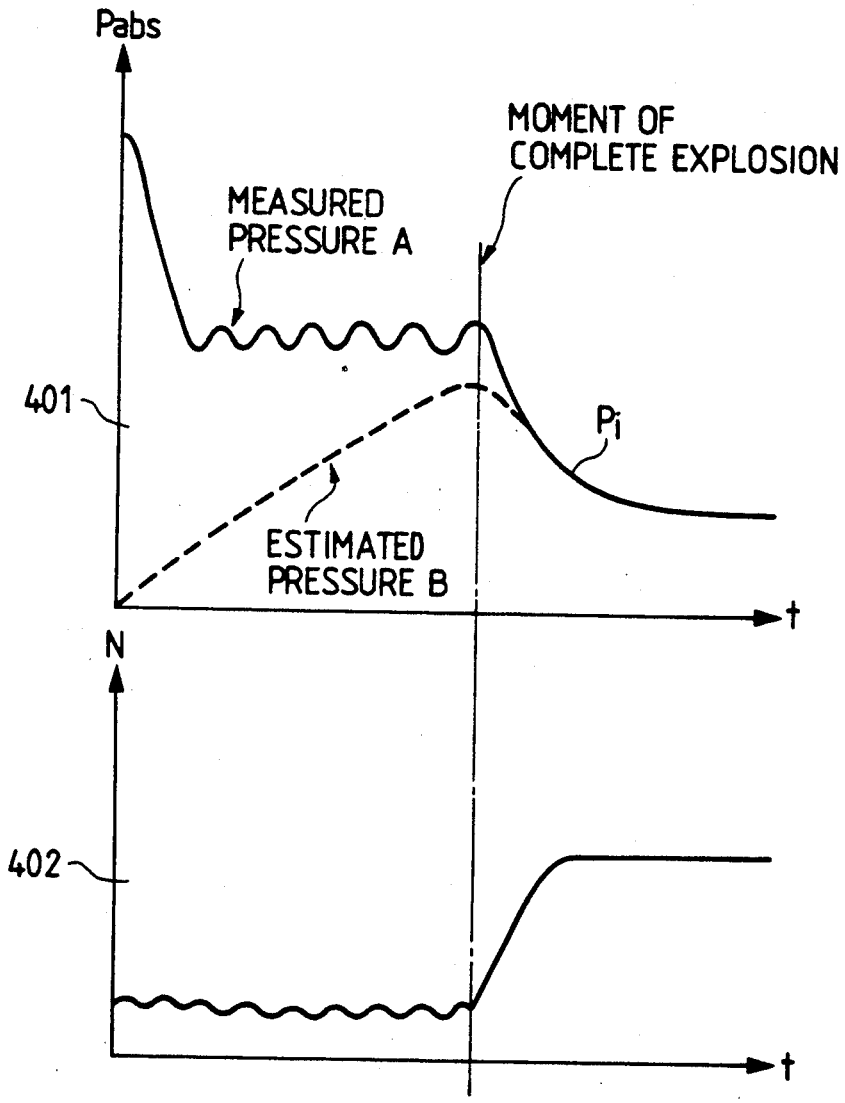
FIG. 5 is a graphical illustration of curves obtained by plotting measured pressure in the intake manifold, estimated pressure in the intake manifold and engine rotating number with respect to time from engine start to the moment near the complete explosion in the engine cylinders for explaining disturbance of the estimated pressure in the intake manifold during the engine start period.

FIG. 5 shows changing characteristics 401 of the pressure Pi in the intake manifold expressed in terms of absolute pressure and a changing characteristic 402 of the engine rotating number N with respect to time during engine starting period. With regard to the changing characteristics 401 of the pressure at the intake manifold, the solid line A indicates a measured pressure characteristic in the intake manifold and the dotted line indicates a calculated estimated pressure characteristic in the intake manifold.

At the time of engine starting-up, the fuel control device for an internal combustion engine is turned on and the volatile memory in the control unit is initialized. For this reason, at the initial stage, the calculated pressure Pi at the intake manifold is far away from the measured pressure, as seen from the changing characteristics 401, and thereafter the calculated pressure Pi gradually converges toward the measured pressure and finally coincides with the measured pressure around a point in time when a complete explosion has been achieved in the engine. Since the air flow rate Qc at the engine cylinder port even during the engine starting period was conventionally determined by making use of the erroneous calculated pressure in the intake manifold, i.e. the pressure calculated from the output of the H/W sensor, a satisfactory starting characteristic of a motor vehicle could not be obtained with the conventional fuel control device and method for an internal combustion engine.

FIG. 1 shows a schematic flowchart for explaining embodiments according to the present invention. As seen from the drawing the control of the present embodiment is activated at a period of every 4 msec.

At first, at step 101, it is judged whether or not the starter switch is turned on. When it is judged that the starter switch is turned on, then it is judged at step 102 whether the engine rotating number N is above a predetermined rotating number. When the engine rotating number N is below the predetermined rotating number, it is determined that the engine is not yet in a state where complete explosion has been achieved, and the process moves to step 103 where the existence or non-existence of a learned initial value of the estimated pressure Pi in the intake manifold is checked. When there exists a learned estimated pressure Pi, the process proceeds to step 302 wherein an air flow rate Qc at the engine cylinder port is retrieved from the PN map based upon the detected engine rotating number N and the learned estimated pressure Pi in the intake manifold. Lastly, the fuel quantity is calculated at step 303 based upon the detected engine rotating number N and the retrieved air flow rate Qc to generate a fuel injection valve driving signal Tp. However, when there exists no learned estimated pressure Pi, the process proceeds from step 103 to step 105, wherein the mass air flow rate Qs at the throttle of the engine, which is obtained by converting the output signal from the H/W sensor not through the PN map, is determined as the estimated air flow rate Qc at the engine cylinder port, and thereafter a fuel injection valve driving signal Tp is calculated at step 303 according to the determined estimated air flow rate Qc.

On the other hand, when it is judged that the starter switch SW is turned off at step 101 or that the engine rotating number exceeds the predetermined rotating number N at step 102, the process moves to steps 301, 302, 303 to determine a fuel injection valve driving signal Tp of post engine starting period, which processing has been explained in detail in connection with FIG. 4.

According to the present embodiment, during the period after the engine has started until the engine reaches a complete explosion condition, the fuel quantity to be injected is determined according to the retrieved air flow rate based upon the learned estimated pressure for the engine starting period instead of the calculated estimated pressure or according to the converted mass air flow rate Qs at the throttle of the engine based upon the output signal from the H/W sensor 1, which is not affected by any disturbance occurring during the convergence period of the digital filter. Therefore, a satisfactory starting characteristic for the motor vehicle is obtained.

In the above embodiment, for judging the complete explosion condition of the engine, a predetermined engine rotating number N is used as a criteria; however, as an alternative, a predetermined time after starter switch SW is turned on can be used as another criteria. In such case, it is preferable to add step 704, as indicated by the dotted block, wherein a timer is incorporated to count the predetermined time and is cleared when the predetermined time has passed.

Further, in the above embodiment, the converted mass air flow rate Qs at the throttle of the engine is used as the estimated air flow rate Qc for the engine starting period when there exists no learned estimated pressure Pi, which is used for retrieving the estimated air flow rate Qc for the engine starting period. However as an alternative, a predetermined fixed air flow rate, which is determined by a theoretical analysis or an experimental study, based on a stabilizing time of the system and a static characteristic of the engine, can be used as the estimated air flow rate Qc for the engine starting period, as indicated by dotted block 706 in FIG. 1.

Figure 6:
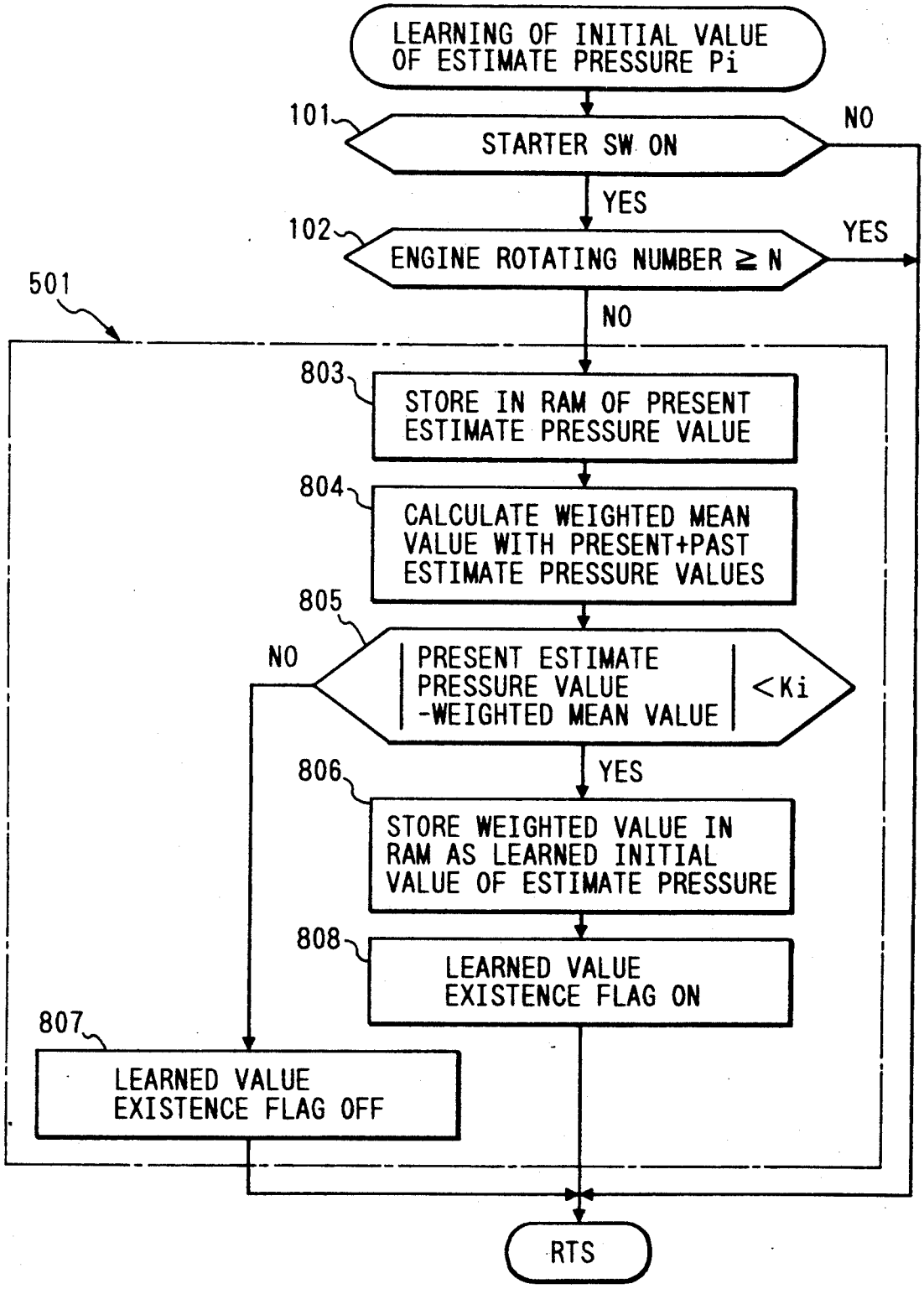
FIG. 6 is a flowchart for explaining in detail the processing in estimated pressure Pi initial value learning 501 as shown in FIG. 1.

FIG. 6 is a flowchart for explaining in detail the estimated pressure initial value learning process 501 shown in FIG. 1. Initially, at steps 101 and 102, the complete explosion condition of the engine is judged, as has been explained.

At step 803, the calculated estimated pressure Pi in the intake manifold, which is determined immediately after complete explosion occurs is stored in the RAM 24 as the present calculated estimated pressure for the engine starting period. Thereafter, at step 804, a weighted mean value is calculated from the past calculated estimated pressures for the engine starting period and the present calculated estimated pressure for the engine starting period, both of which are stored in the RAM 24, and subsequently, when the absolute difference between the present calculated estimated pressure and the calculated weighted mean value is determined to fall below a predetermined value Ki at step 805, the calculated weighted mean value is stored in the RAM 24 as the learned estimated pressure for the engine starting period at step 806. Thereafter, at step 808, a flag indicating existence of the learned value is turned on to complete the processing.

However, when at step 805 the absolute difference is determined to be larger than the predetermined value Ki, the flag indicating the existence of the learned value is turned off to complete the processing.

According to the present invention, the interval from the engine start to the engine start completion is sufficiently shortened, the starting characteristic of a motor vehicle is improved and degradation of exhaust gas is sufficiently suppressed without undesirably effecting the advantages inherent in the fuel control device and method for an internal combustion engine of this kind. Further, the intake air temperature compensation is eliminated because the fuel quantity is determined by making use of the output signal from a heat generating resistor type air flow meter and no influence for the intake manifold charge results because an internal state variable in a form of pressure in the intake manifold is used for determining the fuel quantity.

We claim:

1. A fuel control device for an internal combustion engine, comprising:

a heat generating resistor type air flow meter for measuring intake air flow rate as a measure of intake air flow rate (Qs) at the throttle of the engine;

means for detecting engine rotating number (N);

first means for calculating an estimated pressure (Pi) in the intake manifold of the engine by digital-filtering an output signal from said heat generating resistor type air-flow meter using a pressure difference equation;

means for estimating air flow rate (Qc) at the engine cylinder port flowing into the respective cylinders of the engine by retrieving a value of air flow rate (Qc) from a predetermined map determining the air flow rate based upon the detected engine rotating number (N) and the calculated estimated pressure (Pi) in the intake manifold;

means for judging engine starting period;

means for performing learning an initial value of the estimated pressure (Pi) in the intake manifold during an engine starting period by taking in a calculated estimated pressure (Pi) during the engine starting period approximately at the moment when complete explosion has occurred in the engine cylinders when the engine is judged to be in the engine starting period by said engine starting period judging means, and for storing the learned initial value for engine starting period of the estimate pressure (Pi) in a memory;

wherein said estimating means further includes means for estimating air flow rate (Qc) at the engine cylinder port of air flowing into the respective cylinders of the engine by accessing the predetermined map to determine the air flow rate based upon the detected engine rotating number (N) and the learned initial value for engine starting period of the estimated pressure (Pi) stored in the memory when the engine is judged to be in the engine starting period by said engine starting period judging means, instead of the calculated estimate pressure (Pi) in the intake manifold obtained by said first calculating means; and second means for calculating fuel quantity (Tp) to be injected into the respective engine cylinders based upon the estimated air flow rate (Qc) at the engine cylinder port and the detected engine rotating number (N).

2. A fuel control device for an internal combustion engine according to claim 1, wherein the measured intake air flow rate (Qs) at the throttle of the engine is used as the estimated air flow rate (Qc) at the engine cylinder port for the engine starting period when no learned initial value for engine starting period of the estimated pressure (Pi) is stored in the memory.

3. A fuel control device for an internal combustion engine according to claim 1, wherein a fixed intake air flow rate is used as the estimated air flow rate (Qc) at the engine cylinder port for an engine starting period when no learned initial value for engine starting period of the estimate pressure (Pi) is stored in the memory.

4. A fuel control device for an internal combustion engine according to claim 1, wherein said engine starting period judging means detects the termination of the engine starting period by detecting a complete explosion in the engine.

5. A fuel control device for an internal combustion engine according to claim 1, wherein said engine starting period judging means determines the existence of the engine starting period when a starter switch is turned on and the engine rotating number remains below a predetermined rotating number.

6. A fuel control device for an internal combustion engine according to claim 1, wherein said engine starting period judging means detects the termination of the engine starting period when a predetermined time has passed after a starter switch is turned on.

7. A fuel control device for an internal combustion engine according to claim 1, wherein learned initial value of the estimated pressure (Pi) for the engine starting period as stored in the memory is renewed by incorporating the latest calculated estimated pressure (Pi) during the engine starting period approximately at the moment when complete explosion has occurred.

8. A fuel control method for an internal combustion engine, comprising the steps of:

generating a signal representing intake air flow rate (Qs) at the throttle of the engine using a heat generating resistor type air flow meter;

detecting the rotating number (N) of the engine;

calculating an estimated pressure (Pi) in the intake manifold of the engine by digital-filtering the signal from the heat generating resistor type air flow meter using a pressure difference equation;

estimating an air flow rate (Qc) at the engine cylinder port of air flowing into the respective cylinders of the engine by retrieving a value of air flow rate (Qc) from a predetermined map determining the air flow rate based upon the detected engine rotating number (N) and the calculated estimated pressure (Pi) in the intake manifold;

judging whether or not the engine is in an engine starting period;

performing learning of an initial value of the estimated pressure (Pi) in the intake manifold for an engine starting period by taking in a calculated estimated pressure (Pi) during the engine starting period approximately at the moment when complete explosion in the engine has occurred when the engine is judged to be in an engine starting period;

storing the learned initial value of the estimated pressure (Pi) in a memory;

further estimating air flow rate (Qc) at the engine cylinder port of air flowing into the respective cylinders of the engine by retrieving a value of air flow rate (Qc) from the predetermined map determining the air flow rate based upon the detected engine rotating number (N) and the learned initial value of the estimate pressure (Pi) stored in the memory when the engine is judged in an engine starting period, instead of the calculated estimated pressure (Pi); and calculating a fuel quantity (Tp) to be injected into the respective engine cylinders based upon the estimated air flow rate (Qc) at the engine cylinder part and the detected engine rotating number (N).

* * * * *